US009884353B2

(12) United States Patent
Banholzer et al.

(10) Patent No.: US 9,884,353 B2
(45) Date of Patent: Feb. 6, 2018

(54) DRAIN CLEANER

(71) Applicant: Milwaukee Electric Tool Corporation, Brookfield, WI (US)

(72) Inventors: Hans T. Banholzer, Milwaukee, WI (US); Celene K. Mo, Milwaukee, WI (US); Nikos A. Gainacopulos, Milwaukee, WI (US); Jacqueline J. Beierle, Milwaukee, WI (US); Jeffrey Corbat, Germantown, WI (US); Sean T. Kehoe, Waukesha, WI (US); Ryan James Denissen, Sussex, WI (US); Justin Miller, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 15/426,762

(22) Filed: Feb. 7, 2017

(65) Prior Publication Data

US 2017/0165723 A1 Jun. 15, 2017

Related U.S. Application Data

(63) Continuation of application No. PCT/US2016/065942, filed on Dec. 9, 2016.
(Continued)

(51) Int. Cl.
*B08B 9/047* (2006.01)
*B08B 9/045* (2006.01)
(Continued)

(52) U.S. Cl.
CPC ..... *B08B 9/047* (2013.01); *B08B 9/045* (2013.01); *B65H 75/364* (2013.01); *E03F 9/005* (2013.01)

(58) Field of Classification Search
CPC ..... B08B 9/047; B08B 9/045; E03F 9/005
See application file for complete search history.

(56) References Cited

U.S. PATENT DOCUMENTS 2,223,005 A 11/1940 Kerber
2,244,735 A 6/1941 Silverman
(Continued)

FOREIGN PATENT DOCUMENTS

WO 2006112847 10/2006
WO 2006112848 10/2006
WO 2009143497 11/2009

OTHER PUBLICATIONS

International Search Report and Written Opinion for Application No. PCT/US2016/065942 dated Feb. 10, 2017 (15 pages).

*Primary Examiner* — Shay Karls
(74) *Attorney, Agent, or Firm* — Michael Best & Friedrich LLP

(57) ABSTRACT

A drain cleaner includes a handle assembly having a grip, a motor positioned within the handle assembly, and an actuator supported by the handle assembly adjacent the grip. The actuator is electrically coupled to the motor and operable to selectively energize the motor. The drain cleaner also includes a shroud fixed to and extending forwardly from the handle assembly. The shroud includes a closed end adjacent the handle assembly. The drain cleaner further includes a drum assembly rotatably coupled to the handle assembly and positioned within the shroud. The drum assembly is operable to be rotated by the motor relative to the handle assembly and the shroud. The drain cleaner also includes a flexible cable stored within the drum assembly. The flexible cable is configured to be extended out of the drum assembly and into a drain.

19 Claims, 13 Drawing Sheets

Related U.S. Application Data

(60) Provisional application No. 62/296,453, filed on Feb. 17, 2016, provisional application No. 62/264,916, filed on Dec. 9, 2015.

(51) Int. Cl.
*B65H 75/36* (2006.01)
*E03F 9/00* (2006.01)

(56) References Cited

U.S. PATENT DOCUMENTS 2,297,755 A 10/1942 Faust
2,685,097 A 8/1954 Allen
2,849,870 A 9/1958 Silverman
3,078,486 A 2/1963 Casto et al.
3,093,854 A 6/1963 Silverman
3,246,354 A 4/1966 Cooney et al.
3,268,937 A * 8/1966 Bollinger ..... E03F 9/005 15/104.33
3,414,926 A 12/1968 Bloom
3,460,501 A 8/1969 Silverman
3,480,983 A 12/1969 Caperton
3,574,878 A 4/1971 Shames et al.
3,662,421 A 5/1972 Caperton
3,691,583 A 9/1972 Silverman et al.
4,104,757 A 8/1978 Silverman
4,218,802 A * 8/1980 Babb ..... E03F 9/005 15/104.33
4,317,247 A * 3/1982 Levine ..... E03F 9/005 15/104.33
4,364,139 A 12/1982 Babb et al.
D271,436 S 11/1983 Babb et al.
4,617,693 A 10/1986 Meyer et al.
D287,178 S 12/1986 Babb et al.
4,734,951 A 4/1988 Prange
4,763,374 A 8/1988 Kaye
4,793,017 A * 12/1988 Kaye ..... E03F 9/005 15/104.33
D307,202 S 4/1990 Moss
4,914,775 A 4/1990 Kirk
4,925,214 A 5/1990 Hazelton et al.
D310,280 S 8/1990 Moss
4,956,889 A 9/1990 Kirk
5,009,242 A 4/1991 Prange
5,031,263 A 7/1991 Babb et al.
5,031,276 A 7/1991 Babb et al.
5,130,707 A 7/1992 Hagen
5,365,874 A 11/1994 Dorfman
5,390,389 A 2/1995 Rutkowski et al.
5,419,349 A 5/1995 Swain
5,622,319 A 4/1997 Babb et al.
5,657,505 A 8/1997 Gallagher et al.
5,661,265 A 8/1997 Yarbrough et al.
5,816,165 A 10/1998 Huston
5,901,401 A 5/1999 Rutkowski et al.
5,924,566 A 7/1999 Gibbs
6,009,588 A 1/2000 Rutkowski
6,158,076 A 12/2000 Rutkowski et al.
6,243,905 B1 * 6/2001 Rutkowski ..... B08B 9/045 15/104.33
6,343,398 B1 2/2002 Silverman et al.
6,360,397 B1 3/2002 Babb
6,381,798 B1 5/2002 Rutkowski et al.
6,412,136 B1 7/2002 Rutkowsk
6,470,525 B1 10/2002 Silverman
6,546,582 B2 4/2003 Silverman
6,615,436 B1 9/2003 Burch, Jr. et al.
6,618,891 B2 9/2003 Schmitt
6,618,892 B2 9/2003 Schmitt
6,637,064 B2 10/2003 Silverman et al.
6,760,948 B2 7/2004 Schmitt
6,898,881 B2 5/2005 Morrison
D509,929 S 9/2005 Rutkowski et al.
7,070,044 B2 7/2006 Rosenfeld
7,073,224 B2 7/2006 Schmitt
7,137,503 B2 11/2006 Chesack et al.
7,269,874 B2 * 9/2007 Hung ..... B65H 75/364 15/104.095
7,367,077 B2 5/2008 Rutkowski et al.
D570,558 S 6/2008 Rutkowski et al.
D579,612 S 10/2008 Rutkowski et al.
D582,108 S 12/2008 Duff et al.
7,478,451 B2 1/2009 Rutkowski et al.
D595,911 S 7/2009 Rutkowski et al.
7,676,879 B1 3/2010 Rutenberg et al.
7,685,669 B2 3/2010 Rutkowski et al.
7,729,792 B2 6/2010 Lucas et al.
7,793,608 B1 9/2010 Udouj
7,806,256 B2 10/2010 Wildauer et al.
7,935,192 B2 5/2011 Silverman et al.
8,046,862 B2 11/2011 Eisermann et al.
8,060,968 B2 11/2011 Babb et al.
8,176,593 B2 5/2012 Gress et al.
8,302,491 B2 11/2012 Stack
8,413,347 B2 4/2013 Gress et al.
8,434,186 B2 5/2013 Wildauer et al.
8,539,618 B2 9/2013 Gibson et al.
8,578,949 B2 11/2013 Kalbfeld et al.
8,662,092 B2 3/2014 Kalbfeld et al.
8,826,483 B2 9/2014 Rutkowski et al.
8,899,554 B2 12/2014 Wong et al.
9,234,342 B1 * 1/2016 Beesley ..... E03F 9/005
9,260,847 B2 2/2016 Silverman et al.
2002/0083538 A1 7/2002 Silverman et al.
2002/0189038 A1 12/2002 Silverman
2005/0173277 A1 8/2005 Rich
2008/0098544 A1 5/2008 Rutkowski et al.
2008/0148503 A1 6/2008 Babb et al.
2008/0244816 A1 10/2008 Babb et al.
2009/0292502 A1 11/2009 Gress et al.
2010/0127922 A1 5/2010 Sooy
2010/0139696 A1 7/2010 Silverman et al.
2011/0182656 A1 7/2011 Babb
2014/0223679 A1 8/2014 Silverman et al.
2017/0284078 A1 10/2017 Puzio et al.

* cited by examiner

DRAIN CLEANER

CROSS-REFERENCE TO RELATED APPLICATIONS

This application is a continuation of International Application No. PCT/US2016/065942, filed Dec. 9, 2016, which claims priority to U.S. Provisional Application No. 62/264,916, filed Dec. 9, 2015, and to U.S. Provisional Application No. 62/296,453, filed Feb. 17, 2016, the entire contents of all of which are incorporated by reference herein.

FIELD OF INVENTION

The present invention relates to drain cleaners and to storage containers for drain cleaners.

BACKGROUND

Drain cleaners are commonly sold in plastic cases, such as reclosable blow-molded cases that are shaped to match the drain cleaners. The cases are used to carry the drain cleaners from job to job when not in use. However, these cases can be expensive. In addition, these cases may not have been designed specific to a particular user and application. Also, the cases tend to have crevices that are difficult to clean, and the drain cleaners tend to leave behind residue that is messy and smells if not cleaned.

In addition, drain cleaners can be difficult to use in tight spaces. The drum of a drain cleaner rotates to direct the cable into a drain to clean the drain. When the drain cleaner is used in a tight space, the drum may contact various surfaces. The rotation of the drum can damage these surfaces. Furthermore, the rotation of the drum may be problematic for a user. The rotation of the drum can cause damage to a user's hand. In addition, it may be difficult for a user to grasp the drain cleaner with a second hand to support the drain cleaner because the rotation of the drum interferes.

SUMMARY

In one embodiment, the invention provides a drain cleaner including a handle assembly including a grip, a motor positioned within the handle assembly, and an actuator supported by the handle assembly adjacent the grip. The actuator is electrically coupled to the motor and operable to selectively energize the motor. The drain cleaner also includes a shroud fixed to and extending forwardly from the handle assembly. The shroud includes a closed end adjacent the handle assembly. The drain cleaner further includes a drum assembly rotatably coupled to the handle assembly and positioned within the shroud. The drum assembly is operable to be rotated by the motor relative to the handle assembly and the shroud. The drain cleaner also includes a flexible cable stored within the drum assembly. The flexible cable is configured to be extended out of the drum assembly and into a drain.

In another embodiment, the invention provides a storage container for a drain cleaner. The storage container includes a bucket configured to receive the drain cleaner. The bucket includes a bottom and a sidewall extending upward from the bottom, where the sidewall defines an inner perimeter. The storage container further includes an insert positioned within the bucket. The insert includes a base disposed on the bottom of the bucket. The base includes an outer perimeter that is sized and shaped to correspond to the inner perimeter of the sidewall of the bucket. The insert further includes a plurality of projections extending upwardly from the base. The plurality of projections is spaced apart on the base and is configured to support the drain cleaner above the bottom of the bucket.

In yet another embodiment, the invention provides a system including a drain cleaner having a handle assembly with a grip, a motor positioned within the handle assembly, and an actuator supported by the handle assembly adjacent the grip. The actuator is electrically coupled to the motor and operable to selectively energize the motor. The drain cleaner also includes a drum assembly rotatably coupled to the handle assembly. The drum assembly is operable to be rotated by the motor relative to the handle assembly. The drain cleaner further includes a flexible cable stored within the drum assembly. The flexible cable is configured to be extended out of the drum assembly and into a drain. The system further includes a storage container having a bucket that receives the drain cleaner. The bucket includes a bottom and a sidewall extending upward from the bottom, where the sidewall defines an inner perimeter. The storage container also includes an insert positioned within the bucket. The insert includes a base disposed on the bottom of the bucket. The base includes an outer perimeter that is sized and shaped to correspond to the inner perimeter of the sidewall of the bucket. The insert further includes a plurality of projections extending upwardly from the base. The plurality of projections engages a portion of the drain cleaner to support the drain cleaner above the bottom of the bucket.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
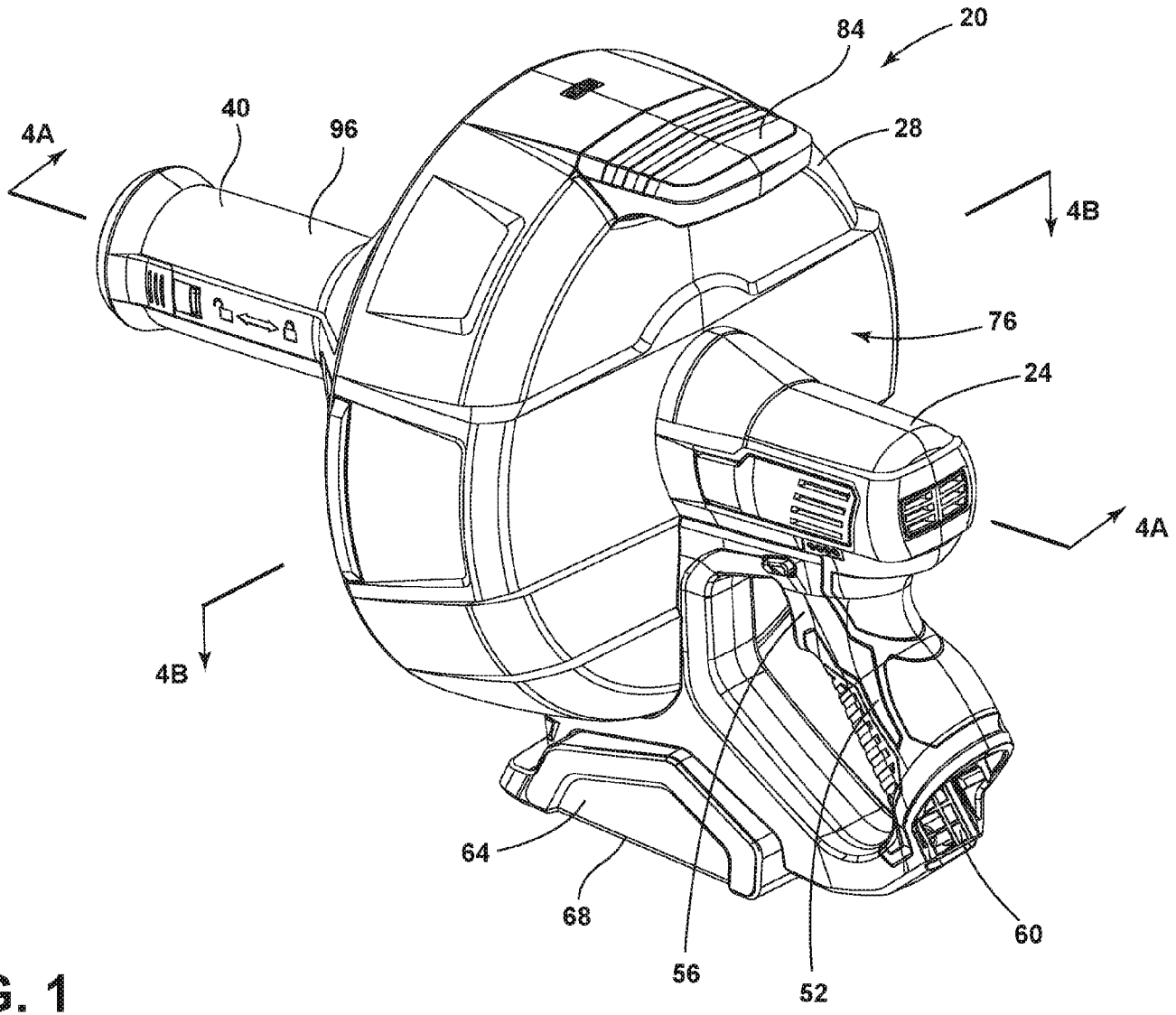
FIG. 1 is a rear perspective view of a drain cleaner according to one embodiment.
Figure 2:
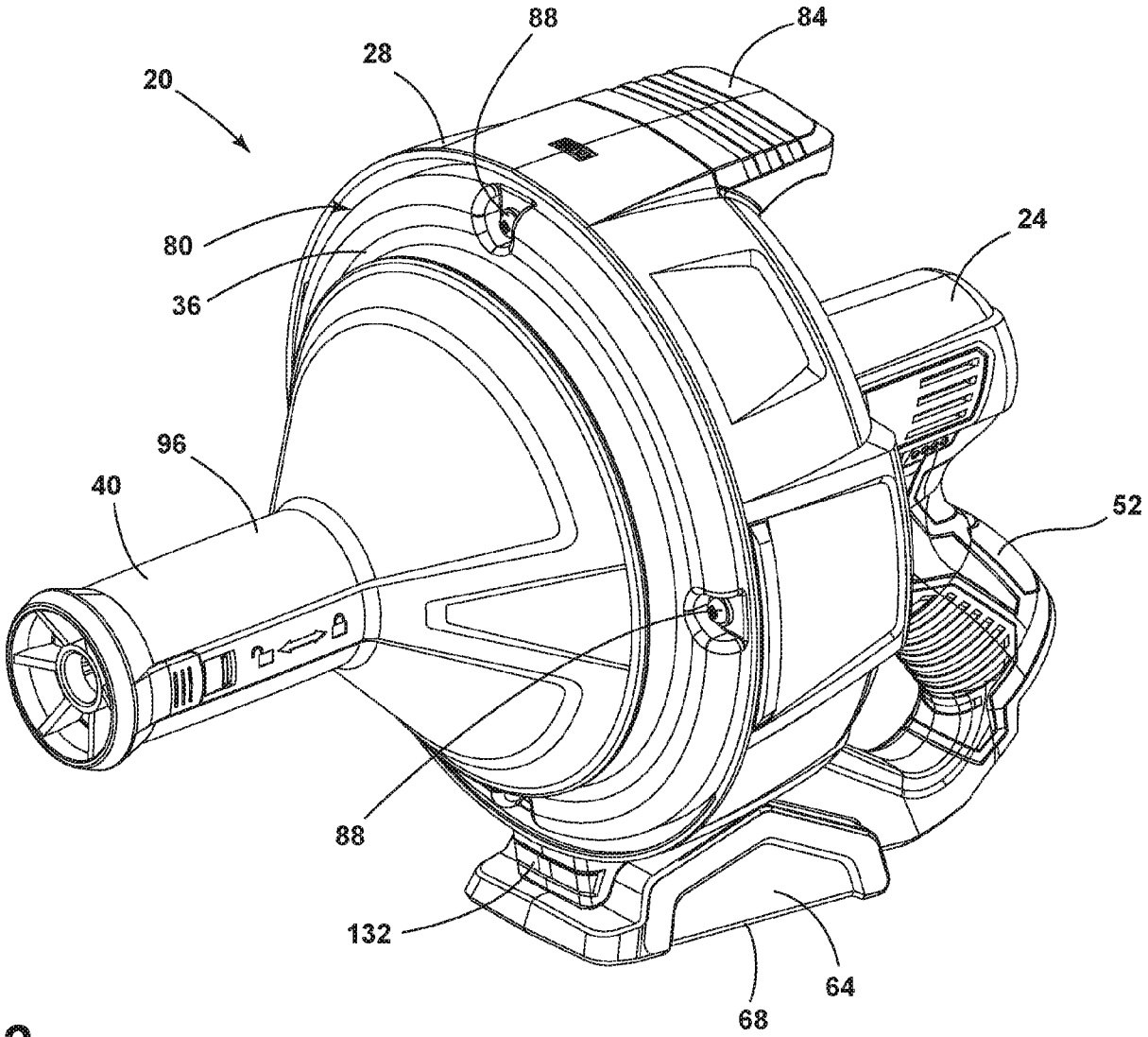
FIG. 2 is a front perspective view of the drain cleaner shown in FIG. 1.
Figure 3:
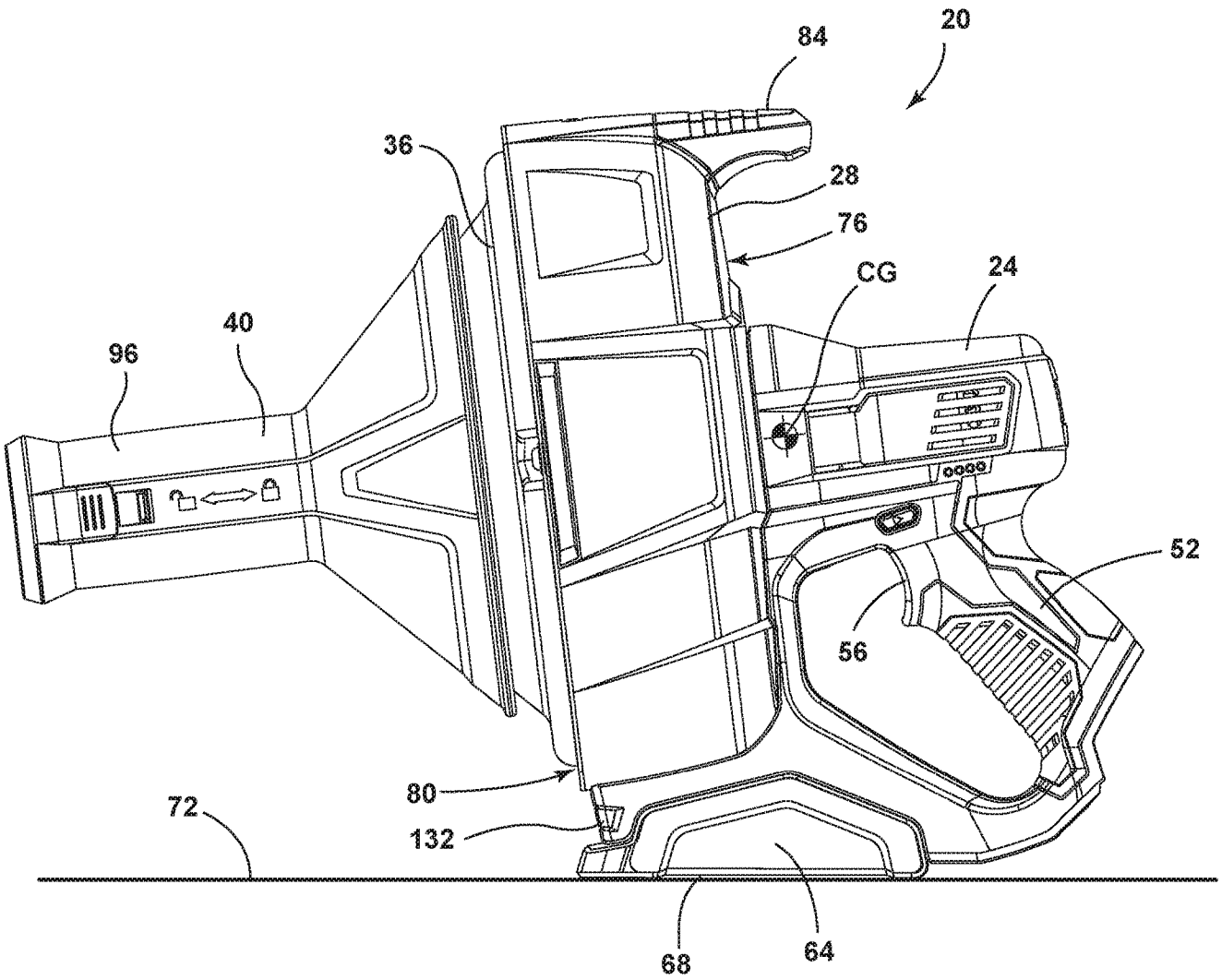
FIG. 3 is a side view of the drain cleaner shown in FIG. 1.
Figure 4A:
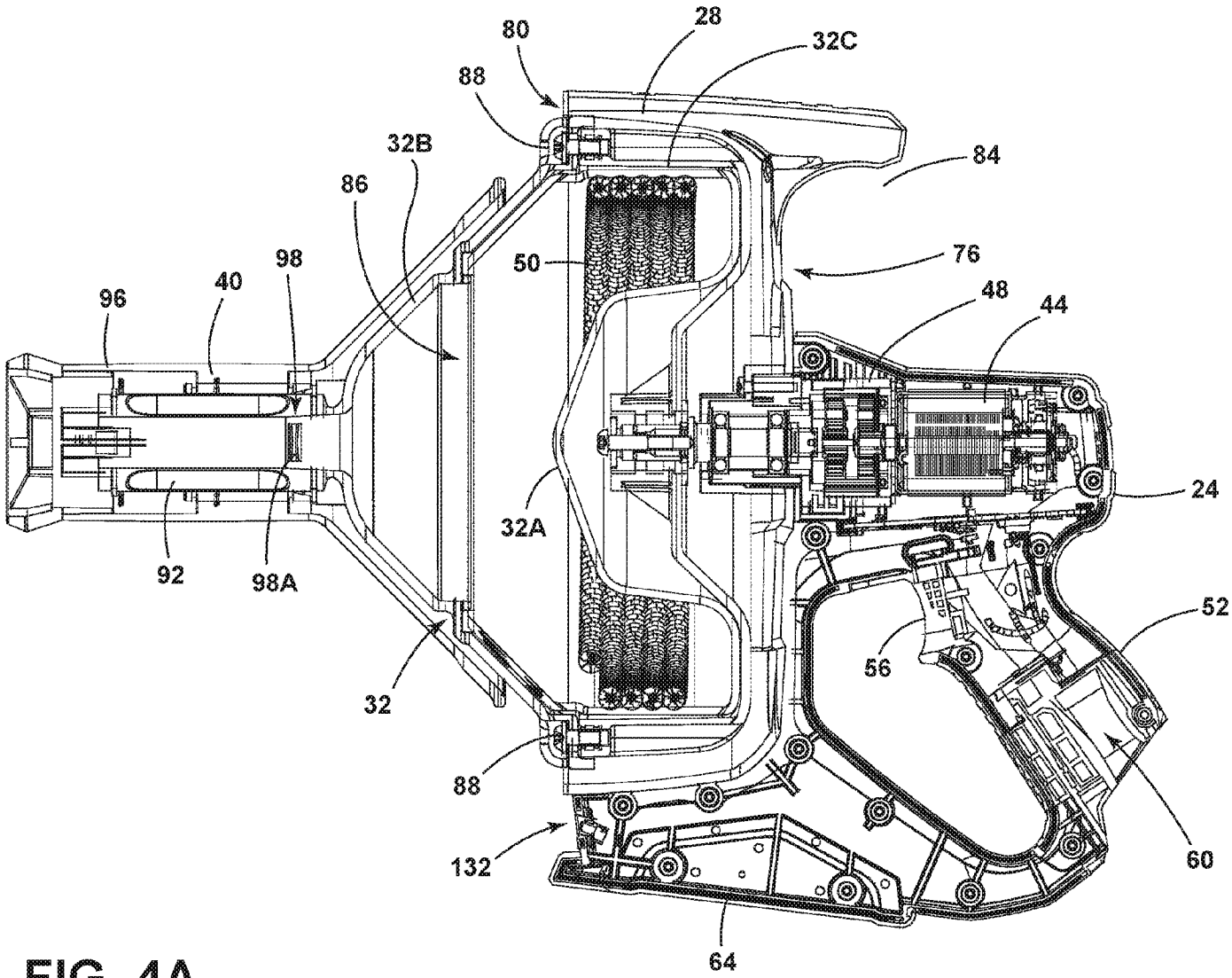
FIG. 4A is a cross-sectional view of the drain cleaner taken along section line 4A-4A of FIG. 1.
Figure 4B:
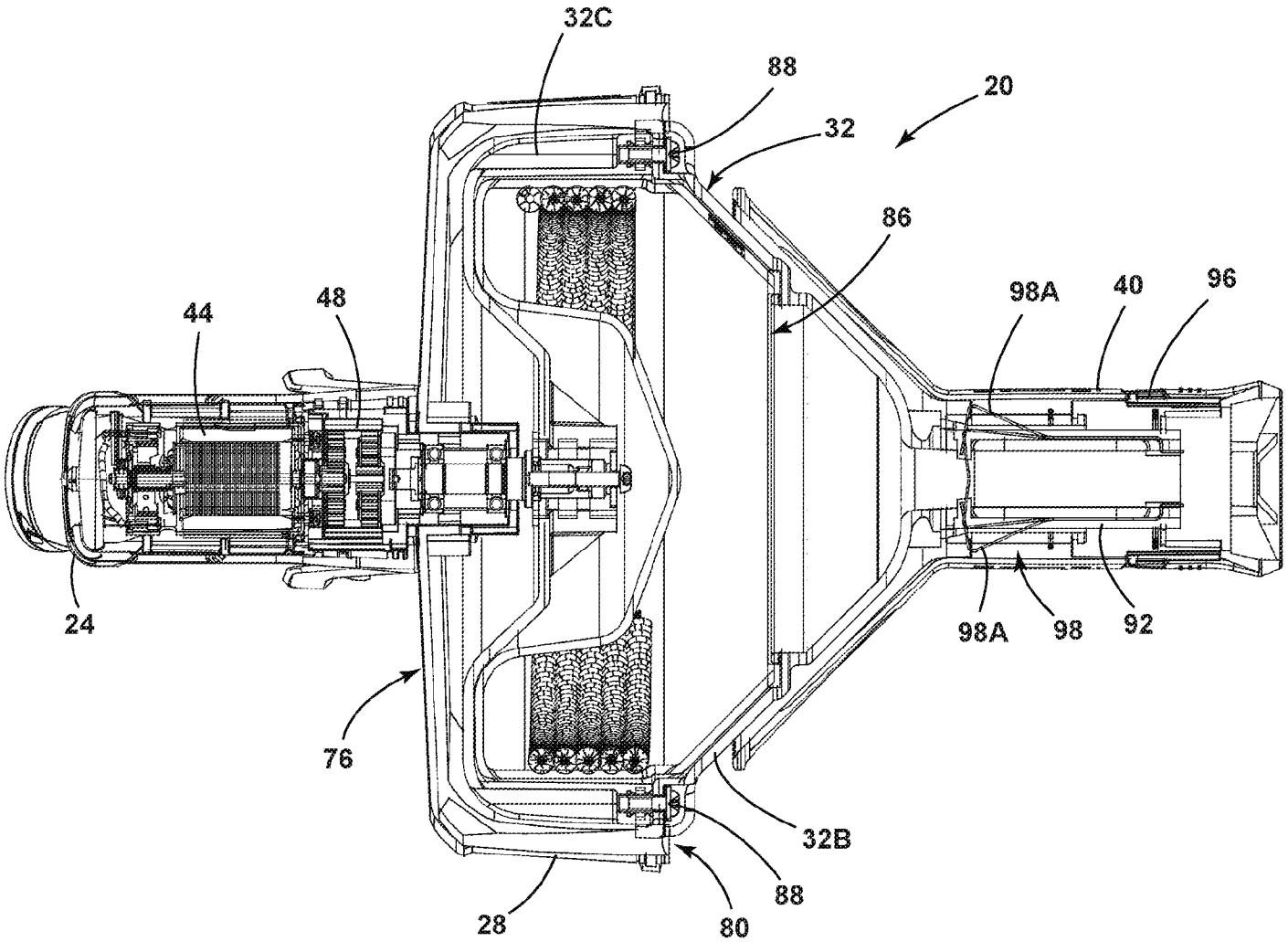
FIG. 4B is a cross-sectional view of the drain cleaner taken along section line 4B-4B of FIG. 1.

FIGS. 1-4B illustrate a drain cleaner 20. The illustrated drain cleaner 20 includes a handle assembly 24, a shroud 28, a drum assembly 32, and a nose assembly 40. In one embodiment, the shroud 28 may be a drum shield. As shown in FIGS. 4A and 4B, the drain cleaner 20 also includes a motor 44 and a drive mechanism 48 positioned within the handle assembly 24. The drain cleaner 20 further includes a flexible cable 50 that is stored within the drum assembly 32 and extends out of the nose assembly 40. The cable 50 is insertable into a drain, or other conduit, for cleaning the drain. In some embodiments, the cable 50 may include an auger head or other tool attachment at its distal end.

The handle assembly 24 extends rearwardly from the shroud 28. The handle assembly 24 includes a grip 52 that is configured to be grasped by a user for carrying and operating the drain cleaner 20. The handle assembly 24 supports an actuator 56 (e.g., a trigger) adjacent the grip 52. The actuator 56 is actuatable (e.g., depressible) by a user to selectively energize the motor 44 and, thereby, operate the drain cleaner 20. The illustrated handle assembly 24 also includes a battery receptacle 60 for receiving and supporting a battery pack, such as a power tool battery pack. The battery receptacle 60 includes terminals that electrically connect the battery pack to the motor 44 and the actuator 56. In other embodiments, the handle assembly 24 may support a power cord to electrically connect the motor 44 to an AC power source.

As shown in FIG. 3, the illustrated handle assembly 24 further includes a stand 64. In one embodiment, the stand 64 is a base. The stand 64 is positioned generally beneath the shroud 28 and the motor 44. More particularly, the stand 64 is positioned beneath a center of gravity CG of the drain cleaner 20, which is principally defined by the motor 44, the drive mechanism 48, the cable 50, and the battery pack (if present) of the drain cleaner 20. The stand 64 includes a generally planar surface 68 that is configured to engage and rest on a support surface 72 (e.g., a table, a workbench, a countertop, the floor, etc.). In one embodiment, the stand 64 may provide ease of use during operation. The stand 64 supports the drain cleaner 20 in an upright position (as illustrated in FIG. 3) with the nose assembly 40 spaced apart from the support surface 72.

Referring back to FIGS. 1-3, the shroud 28 is coupled to the handle assembly 24 generally above the stand 64. The illustrated shroud 28 is generally cup-shaped and includes a closed end 76 adjacent or facing the handle assembly 24 and an open end 80 adjacent or facing the drum cover 32B. The shroud 28 is fixed to the handle assembly 24 such that the shroud 28 is stationary (i.e., does not rotate or otherwise move) relative to the handle assembly 24 during operation of the drain cleaner 20. The shroud 28 is positioned around the drum assembly 32 to help protect the drum assembly 32. The shroud 28 also inhibits the drum assembly 32 from contacting surrounding structures or surfaces, allowing the drain cleaner 20 to be used in relatively tight spaces without the drum assembly 32 contacting and potentially marring the surrounding structures or surfaces as it rotates. Further, the shroud 28 protects a user from the spinning drum assembly 32, and provides ease of use if the user supports the drain cleaner 20 with his/her body during operation (e.g., rests the drain cleaner 20 on a knee or hip). In the illustrated embodiment, the shroud 28 includes a carrying handle 84. The carrying handle 84 extends rearwardly from an upper side of the shroud 28 (i.e., from a side of the shroud 28 opposite the stand 64). The carrying handle 84 facilitates lifting and carrying the drain cleaner 20 when not in use. In some embodiments, the handle 84 may be omitted.

As shown in FIGS. 4A and 4B, the drum assembly 32 is positioned substantially within the shroud 28. The illustrated drum assembly 32 includes an inner drum 32A, a drum cover 32B, and a drum support 32C. The inner drum 32A is configured to support the cable 50 of the drain cleaner 20. The inner drum 32A is positioned at least partially within the drum support 3C and includes an open forward end 86. The drum cover 32B extends over the open forward end 86 of the inner drum 32A. The drum cover 32B is also coupled to the drum support 32C. In the illustrated embodiment, the drum cover 32B is coupled to the drum support 32C with threaded fasteners 88 (e.g., screws). The threaded fasteners 88 allow the drum cover 32B to be removed from the drum support 32C for replacing and/or cleaning the cable 50 and inside of the drum assembly 32. When the drum cover 32B is secured to the drum support 32C, the inner drum 32A is captured or sandwiched between the drum cover 32B and the drum support 32C so that the entire drum assembly 32 moves (e.g., rotates) together. In other embodiments, the drum cover 32B may be coupled to the drum support 32C with other suitable coupling means.

The drum support 32C is coupled to the drive mechanism 48 such that rotation of the motor 44 is transmitted to the drum assembly 32 through the drive mechanism 48. Friction between the inner surface of the inner drum 32A and the cable 50 causes the cable 50 to rotate or spin with the drum assembly 32. As the drum assembly 32 rotates, the cable 50 also rotates, causing the cable 50 to be extended into the drain or retracted from the drain. The illustrated drive mechanism 48 includes a gear train having, for example, planetary gear arrangements and an output shaft that transmit rotation of the motor 44 to the drum support 32C. In the illustrated embodiment, the drum support 32C is threadably coupled to the output shaft of the drive mechanism 48. In other embodiments, the drum support 32C may be coupled to the drive mechanism 48 using other suitable means to transmit force (e.g., rotation) from the drive mechanism 48 to the drum assembly 32. Additionally, in some embodiments, other suitable drive mechanisms may also or alternatively be employed.

With continued reference to FIGS. 4A and 4B, the illustrated drum cover 32B includes an extended portion 92 that extends away from the drum assembly 32 and into the nose assembly 40. The extended portion 92 guides the cable 50 from the drum assembly 32 out of the drain cleaner 20. The nose assembly 40 is positioned forward of the shroud 28 and provides a second grip 96 for a user to hold the drain cleaner 20 during operation. For example, a user can grasp the grip 52 of the handle assembly 24 with one hand to operate the actuator 56, and can grasp the second grip 96 of the nose assembly 40 with the other hand to help guide the drain cleaner 20.

The illustrated nose assembly 40 also provides a lock mechanism 98 for the drain cleaner 20. In particular, the nose assembly 40 is slidable toward and away from the drum assembly 32 to selectively lock and unlock the cable 50, respectively. In the illustrated embodiment, the lock mechanism 98 includes two spring clips 98A positioned within the nose assembly 40 on opposite sides of the extended portion 92 of the drum cover 32B. When the nose assembly 40 is slid toward the drum assembly 32, the spring clips 98A are pushed inwardly to engage the cable 50. In this position, the cable 50 is forced to rotate with the drum assembly 32 since the spring clips 98A move with the extended portion 92 of the drum cover 32B. When the nose assembly 40 is slid away from the drum assembly 32, the spring clips 98A are biased apart from each other and disengage the cable 50 so that the cable 50 can be fed out of or into the drum assembly 32. In some embodiments, the nose assembly 40 may be biased away from the drum assembly 32 (i.e., toward an unlocked position) by a spring or other biasing member. Although the illustrated nose assembly 40 slides axially between engaged and disengaged positions, in other embodiments, the nose assembly 40 may rotate between the engaged and disengaged positions.

As shown in FIGS. 2-4A, the drain cleaner 20 also includes a light 132. The illustrated light 132 is supported by the handle assembly 24 between the shroud 28 and the stand 64. The light 132 is also electrically coupled to the battery pack (or other power source of the drain cleaner 20) through the actuator 56. When the actuator 56 is depressed by a user to rotate the drum assembly 32, the light 132 is also powered to illuminate an area in front of the drain cleaner 20. In some embodiments, the light 132 may include a light emitting diode (LED) or LED array. In other embodiments, other suitable lights may be employed.

Figure 5:
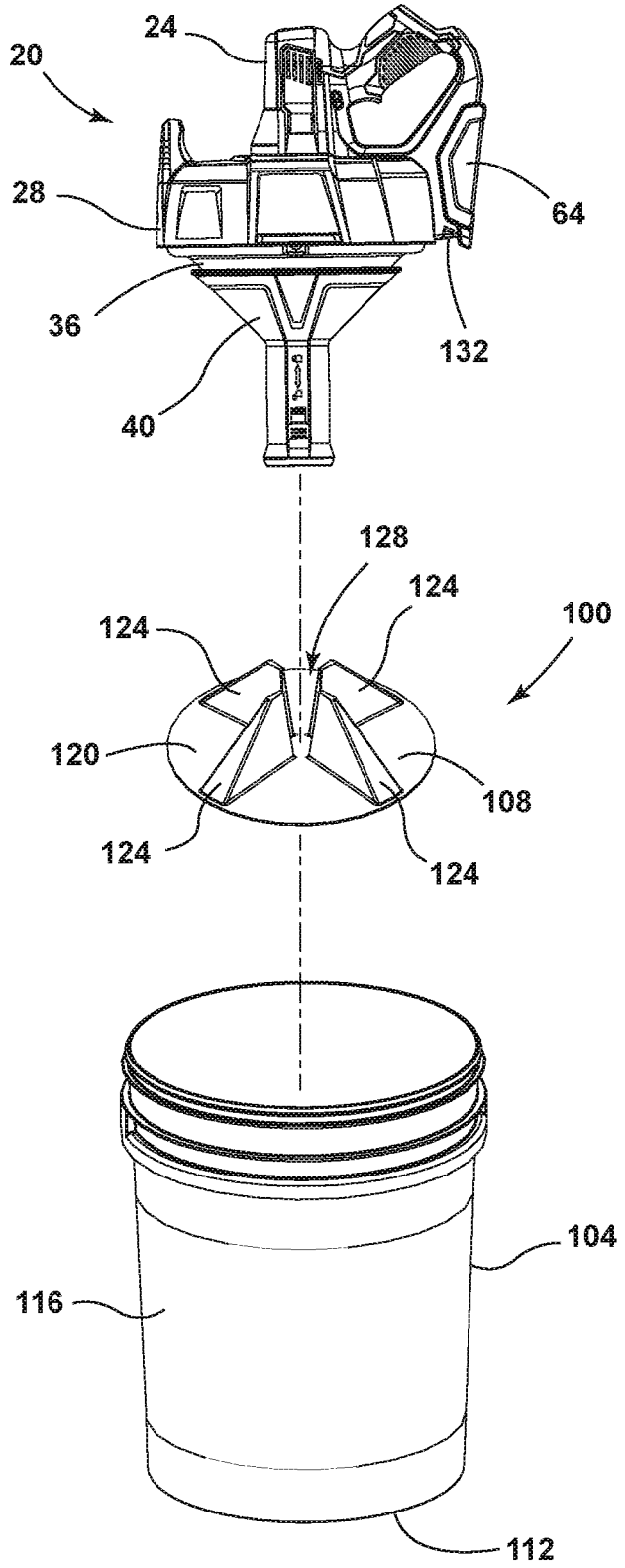
FIG. 5 is an exploded perspective view of the drain cleaner shown in FIG. 1 and a storage container.
Figure 7:
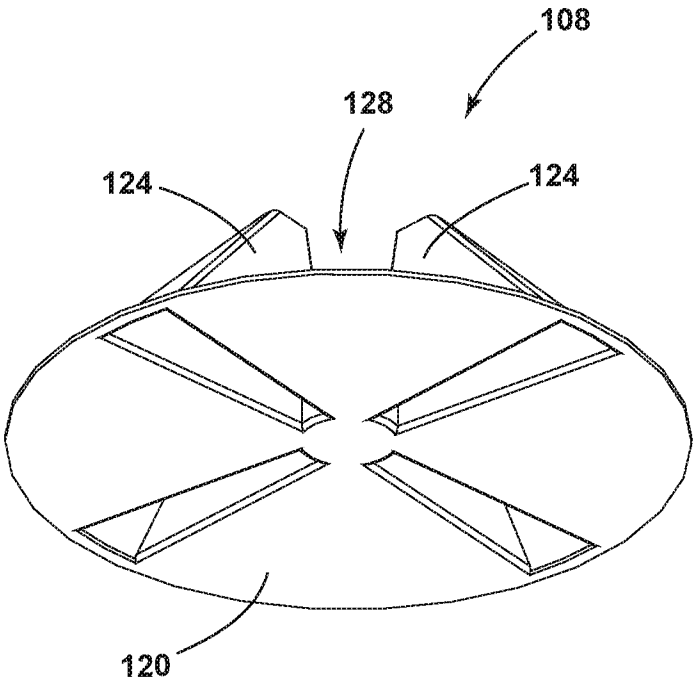
FIG. 7 is a bottom perspective view of the insert shown in FIG. 6.
Figure 6:
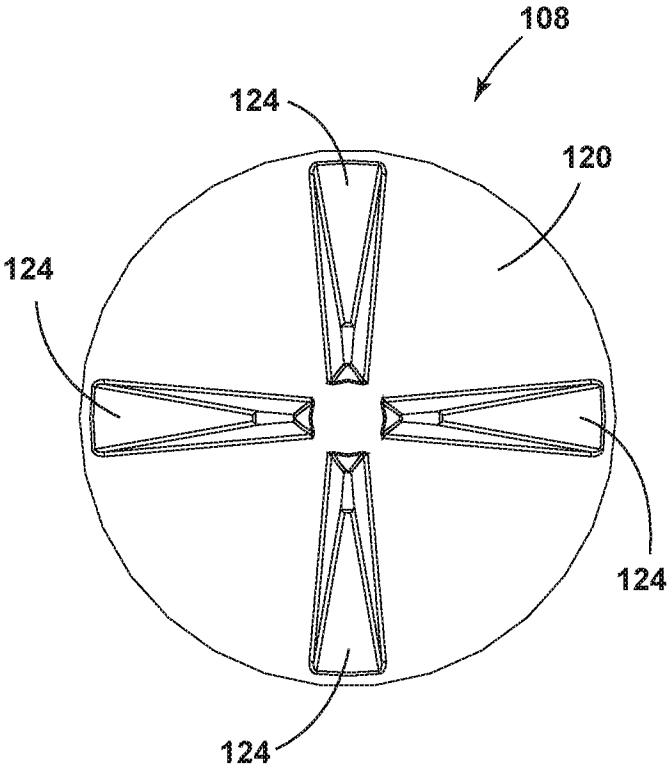
FIG. 6 is a top view of an insert for use with the storage container shown in FIG. 5.

FIG. 5 illustrates a storage container 100 for the drain cleaner 20. The illustrated storage container 100 includes a bucket 104 and an insert 108. The bucket 104 is, for example, a 5-gallon bucket having a bottom 112 and a generally cylindrical sidewall 116. In other embodiments, the storage container 100 may include different sized and/or shaped open-topped containers. For example, the bucket 104 may be a container having a rectangular-, oval-, or polygonal-shaped sidewall. In some embodiments, the bucket 104 (or other container) may also include a handle for carrying the bucket 104. Furthermore, a lid may be selectively coupled to an upper edge of the sidewall 116 to enclose the bucket 104 (or other container). The bucket 104 is configured to receive the drain cleaner 20 for storing and/or transporting the drain cleaner 20. In some embodiments, the bucket 104 may also be sold with the drain cleaner 20 as the carrying case for the drain cleaner 20. In one embodiment, the storage bucket 104 may be designed to accommodate specific users to reduce mess and allow for storage and transport of a drain cleaner, as well as additional tools and/or accessories that may be used during a drain cleaning operation in conjunction with the drain cleaner (e.g., locking pliers, rags, etc.).

The insert 108 is positionable inside the bucket 104 to help support the drain cleaner 20 within the bucket 104. The insert 108 includes a base 120 and a plurality of projections 124 extending upward from the base 120. The base 120 is planar, with a generally flat top surface and bottom surface. The flat bottom surface of the base 120 enables the base 120 to sit flat on the inside of the bucket 104. The base 120 has an outer perimeter that corresponds to an inner perimeter of the wall 116 of the bucket 104. The illustrated insert 108 includes a circular base 120 and four projections 124 extending perpendicularly from the base 120. In the illustrated embodiment, the circular base 120 and the projections 124 are integrally formed as a single piece of plastic. In other embodiments, the insert 108 may include fewer or more projections 124, the base 120 and the projections 124 may be formed as separate pieces that are coupled together, and/or the insert 108 may be formed of other material(s). The circular base 120 generally corresponds to the shape and size of the bottom 112 of the bucket 104. The projections 124 are circumferentially spaced evenly around the circular base 120. The illustrated projections 124 are generally triangular in shape and taper in height from the center of the base 120 toward the outer perimeter of the base 120. The projections 124 are configured to engage the nose assembly 40 of the drain cleaner 20 to support the drain cleaner 20 above the bottom 112 of the bucket 104. A central gap 128 formed between the projections 124 at the center of the base 120 provides clearance for a cable of the drain cleaner 20 when the drain cleaner 20 is supported by the insert 108. In one embodiment, this configuration may tend to prevent or deter damaging or bending of a cable tip while allowing the tool to rest upside-down in a bucket to allow draining of liquid or debris from the tool after use.

In the illustrated embodiment, the insert 108 is free floating within the bucket 104. This arrangement allows the insert 108 to be easily removed from the bucket 104 for cleaning. In other embodiments, the insert 108 may be releasably secured to the bucket 104. In further embodiments, the insert 108 may be permanently secured to the bottom 112 of the bucket 104, or the projections 124 of the insert 108 may be integrally formed in the bottom 112 of the bucket 104. As noted above, the bucket 104 may be replaced with a different sized or shaped container, in which case the insert 108 may be correspondingly shaped and sized to fit within the container and support the drain cleaner 20 above the bottom of the container.

Figure 8:
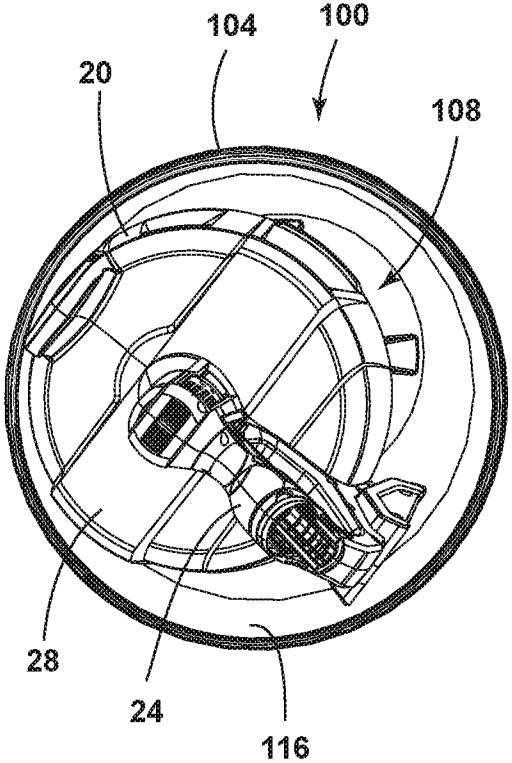
FIG. 8 is a top view of the drain cleaner positioned within the storage container.

FIG. 8 illustrates the drain cleaner 20 positioned within the bucket 104 for storage or sale. The insert 108 is positioned at the bottom 112 of the bucket 104 and contacts the nose assembly 40 of the drain cleaner 20 to support the drain cleaner 20 above the bottom 112 of the bucket 104.

Figure 9:
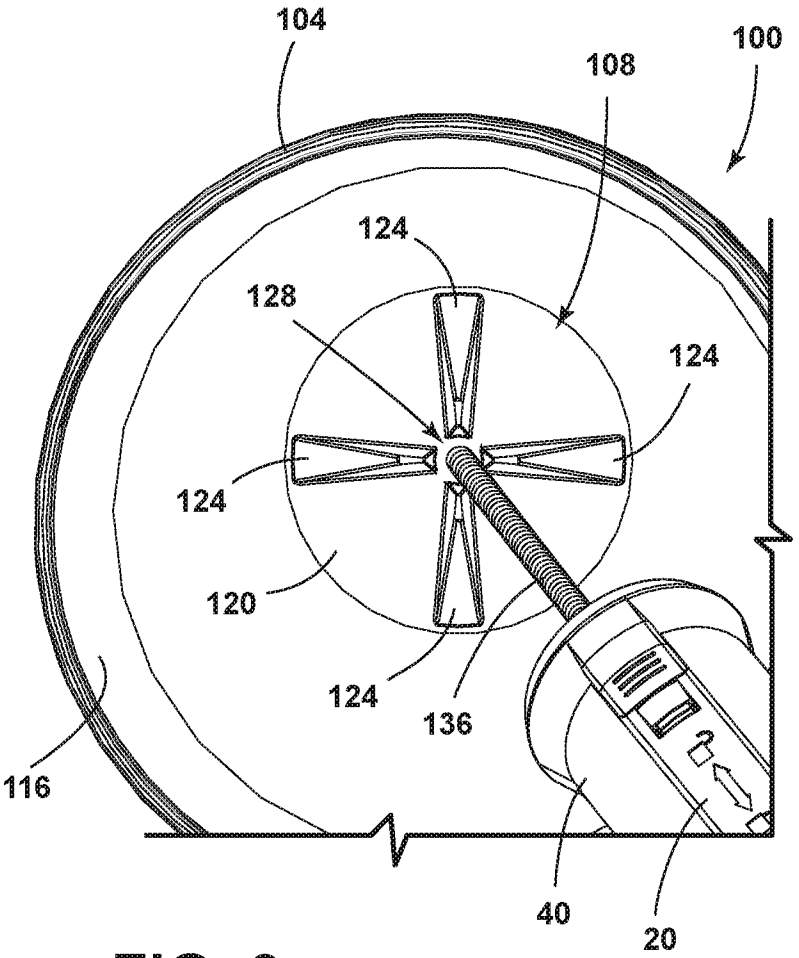
FIG. 9 is a detailed view of the drain cleaner being removed from the storage container.

FIG. 9 illustrates the storage container 100 with the drain cleaner 20 removed. The insert 108 is positioned at the bottom 112 of the bucket 104. A cable 136 extends from the nose assembly 40 of the drain cleaner 20. The insert 108 provides clearance for a distal end section 140 of the cable 136 so that the cable 136 is not unintentionally bent or otherwise deformed while the drain cleaner 20 is stored within the bucket 104.

Figure 10:
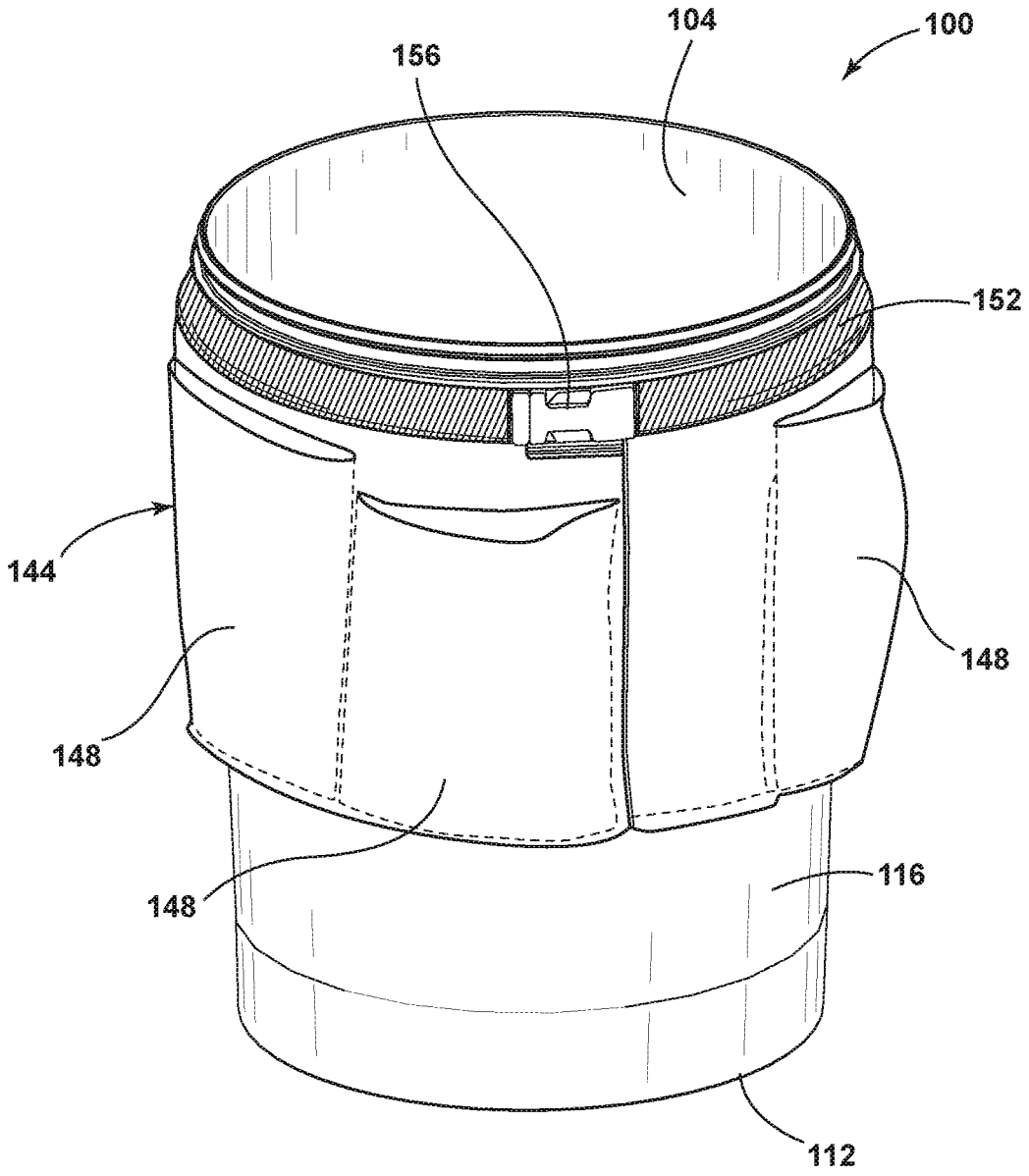
FIG. 10 is a perspective view of the storage container shown in FIG. 5, the storage container including an apron.
Figure 11:
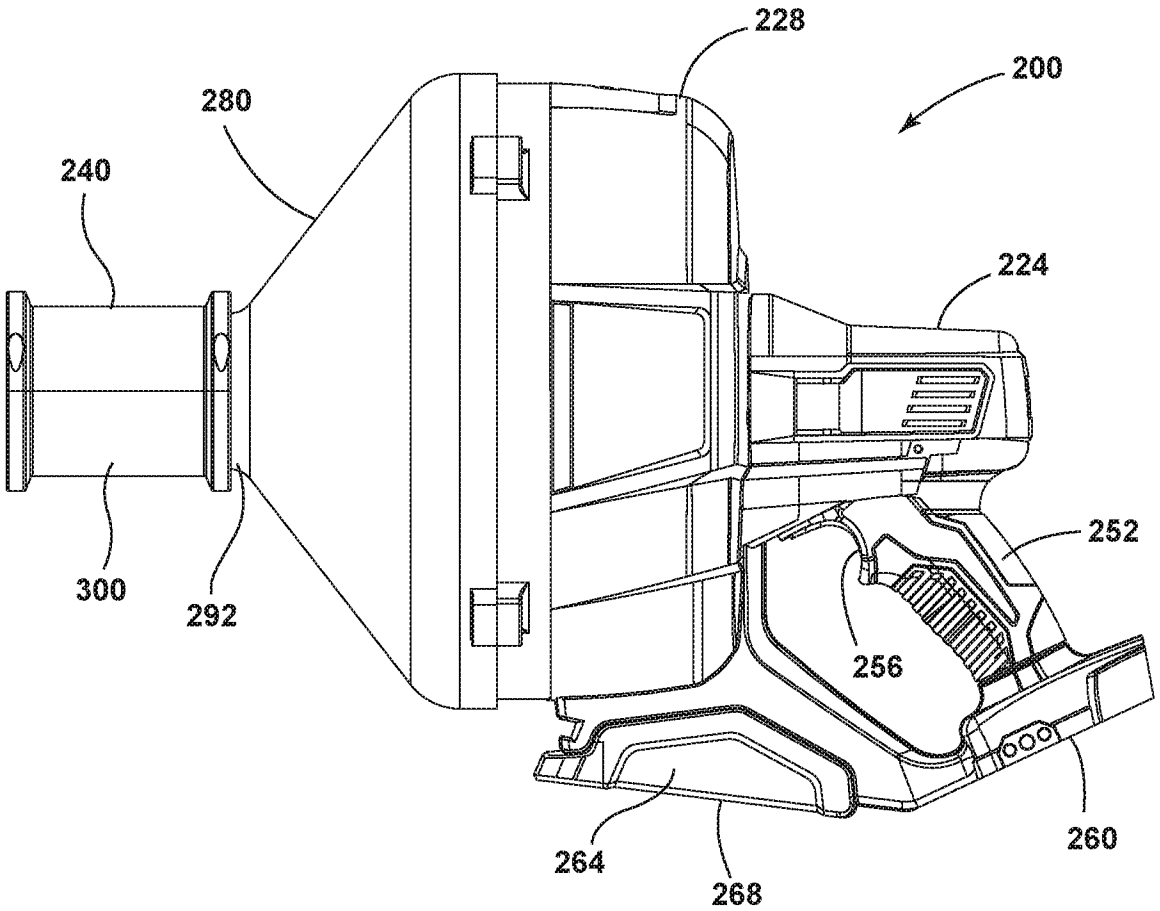
FIG. 11 is a side view of a drain cleaner according to another embodiment.

FIG. 10 illustrates the storage container 100 with a shroud or apron 144 (e.g., a bucket organizer wrap) coupled to the bucket 104. The apron 144 may be made of a fabric material, such as canvas. In another embodiment, the apron 144 is made from polyester or nylon. In other embodiments, other suitable materials may be used. The apron 144 wraps around the sidewall 116 of the bucket 104 and includes pockets 148 for storing items associated with the drain cleaner 20 (e.g., battery packs, cable attachments, brushes, etc.). In the illustrated embodiment, the apron 144 also includes a belt 152 that tightly engages the bucket 104 to suspend the apron 144 from the bucket 104. Ends of the belt 152 are secured together by a buckle 156 so that the apron 144 is removable from the bucket 104. In other embodiments, the ends of the belt 152 may be secured together with loops, snaps, Velcro, or the like. In further embodiments, the apron 144 may include hooks that extend over an upper edge of the bucket 104 to suspend the apron 144 from the bucket 104. In each of these embodiments, none of the apron 144 extends inside the bucket 104, which reduces the possibility of soiling the apron 144.

FIGS. 11-14 illustrate another drain cleaner 200 that is similar to the drain cleaner 20 discussed above. In the illustrated embodiment, the drain cleaner 200 includes a handle assembly 224, a shroud 228, a drum 232, and a nose assembly 240. The drain cleaner 200 also includes a motor 244 and a drive mechanism 248 positioned within the handle assembly 224. The drain cleaner 200 further includes a flexible cable (not shown) that is stored within the drum 232 and extends out of nose assembly 240. The cable is insertable into a drain, or other conduit, for cleaning the drain.

The handle assembly 224 includes a grip 252 that is configured to be grasped by a user for carrying and operating the drain cleaner 200. The handle assembly 224 supports an actuator 256 (e.g., a trigger) adjacent the grip 252. The actuator 256 is actuatable by a user to selectively energize the motor 244 and, thereby, operate the drain cleaner 200. The illustrated handle assembly 224 also includes a battery receptacle 260 for receiving and supporting a battery pack.

The handle assembly 224 further includes a stand 264. In the illustrated embodiment, the stand 264 is positioned generally beneath the shroud 228 and the motor 244. More particularly, the stand 264 is positioned beneath a center of gravity of the drain cleaner 200, which is principally defined by the motor 244, the drive mechanism 248, the cable, and the battery pack (if present) of the drain cleaner 200. The stand 264 includes a generally planar surface 268 that is configured to engage and rest on a support surface. The stand 264 supports the drain cleaner 200 in an upright position with the nose assembly 240 spaced apart from the support surface.

The shroud 228 is coupled to the handle assembly 224 generally above the stand 264. The illustrated shroud 228 is generally cup-shaped and includes a closed end 276 adjacent or facing the handle assembly 224. The shroud 228 is fixed to the handle assembly 224 such that the shroud 228 is stationary (i.e., does not rotate or otherwise move) relative to the handle assembly 224 during operation of the drain cleaner 200. The shroud 228 is positioned around the drum 232 to help protect the drum 232. The shroud 228 allows the drain cleaner 200 to be used in relatively tight spaces without the drum contacting surrounding structures. The shroud 228 also protects a user from the spinning drum assembly 232.

The drum 232 is positioned substantially within the shroud 228. The drum 232 is rotatably driven by the motor 244, which in turn, rotates the cable. Specifically, the drum 232 rotates within and relative to the shroud 228. The motor 244 and the drive mechanism 248 are nested within a cavity 242 formed within the center of the drum 232. The cable is coiled around the outside of the cavity 242 while the motor 244 and drive mechanism 248 engage with the drum 232 from the inside of the cavity 242.

The illustrated drain cleaner 200 further includes an outer shield 280. The outer shield 280 is fixed to a shroud 228 of the drain cleaner 200 to completely enclose the drum 232. In some embodiments, a seal 246 is formed between the shroud 228 and the shield 280 to seal in water. The seal 246 can be formed by an elastomer, plastic, or any other known material capable of forming a water tight connection between the shroud 228 and the shield 280. The outer shield 280 also forms part of the nose assembly 240 of the illustrated drain cleaner 200. By completely enclosing the rotating drum 232, the outer shield 280 facilitates working in enclosed spaces and inhibits inadvertent contact between the drum 232 and any fixtures, cabinets, or other nearby surfaces.

The nose assembly 240 includes an elongated portion 292 that guides the cable into the drain. In the illustrated embodiment, the elongated portion 292 of the nose assembly 240 is formed by the outer shield 280. Specifically, the outer shield 280 and the elongated portion 292 are formed as a continuous element. In other embodiments, the nose assembly 240 is a separate element from the outer shield 280.

Figure 12:
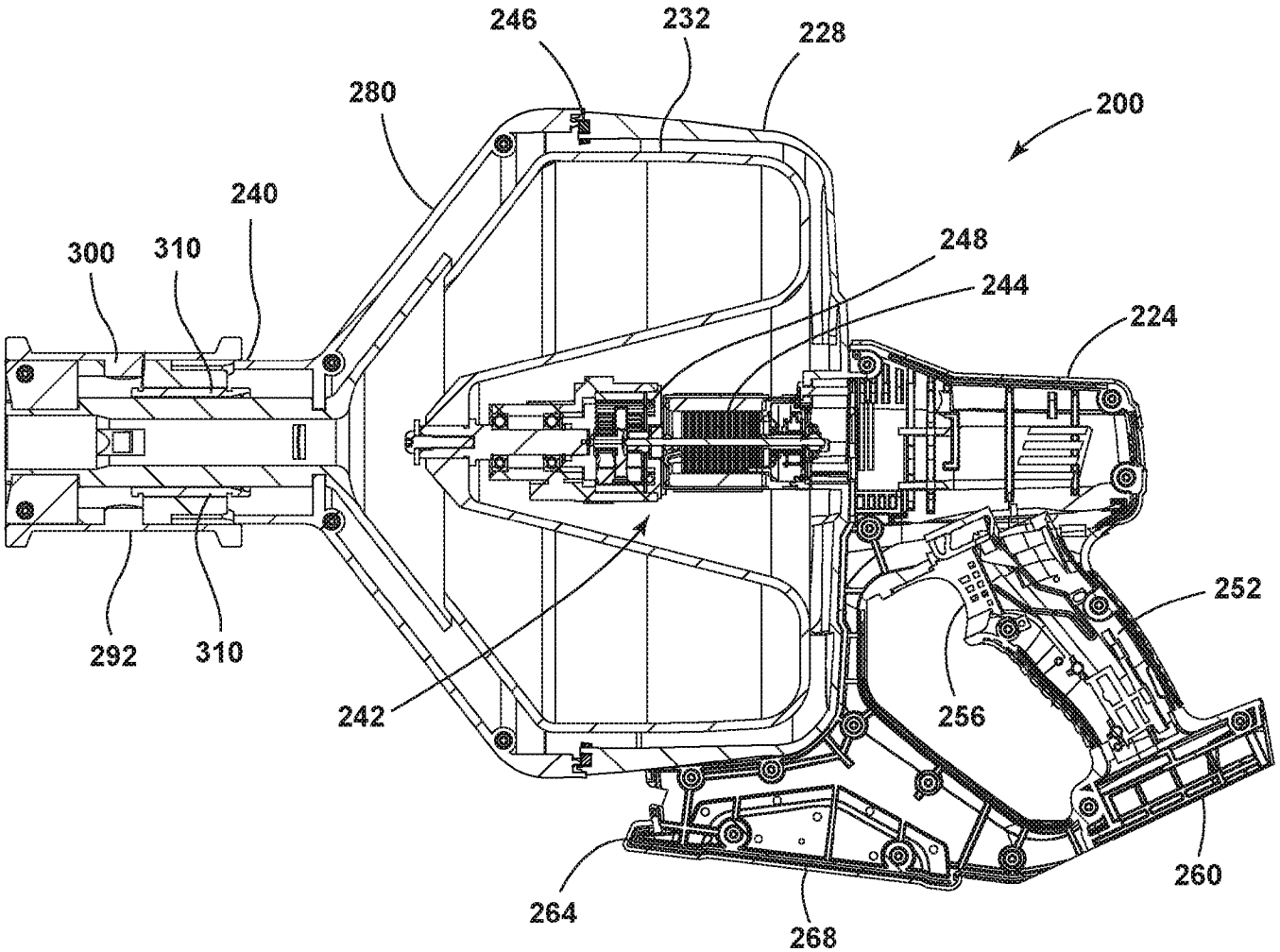
FIG. 12 is a cross-sectional view of the drain cleaner shown in FIG. 11, the drain cleaner including a cable lock mechanism in an unclamped position.
Figure 13:
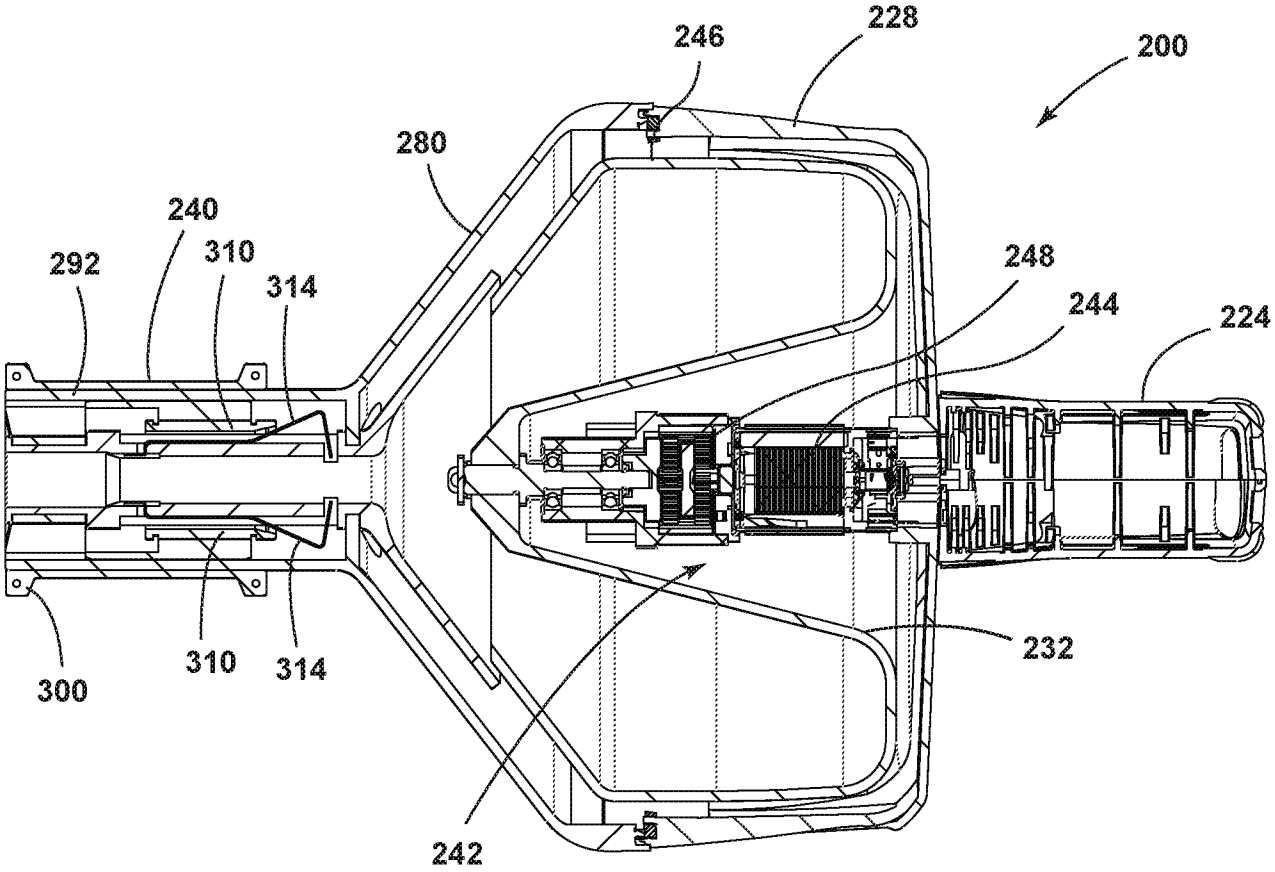
FIG. 13 is another cross-sectional view of the drain cleaner shown in FIG. 11 with the cable lock mechanism in the unclamped position.
Figure 14:
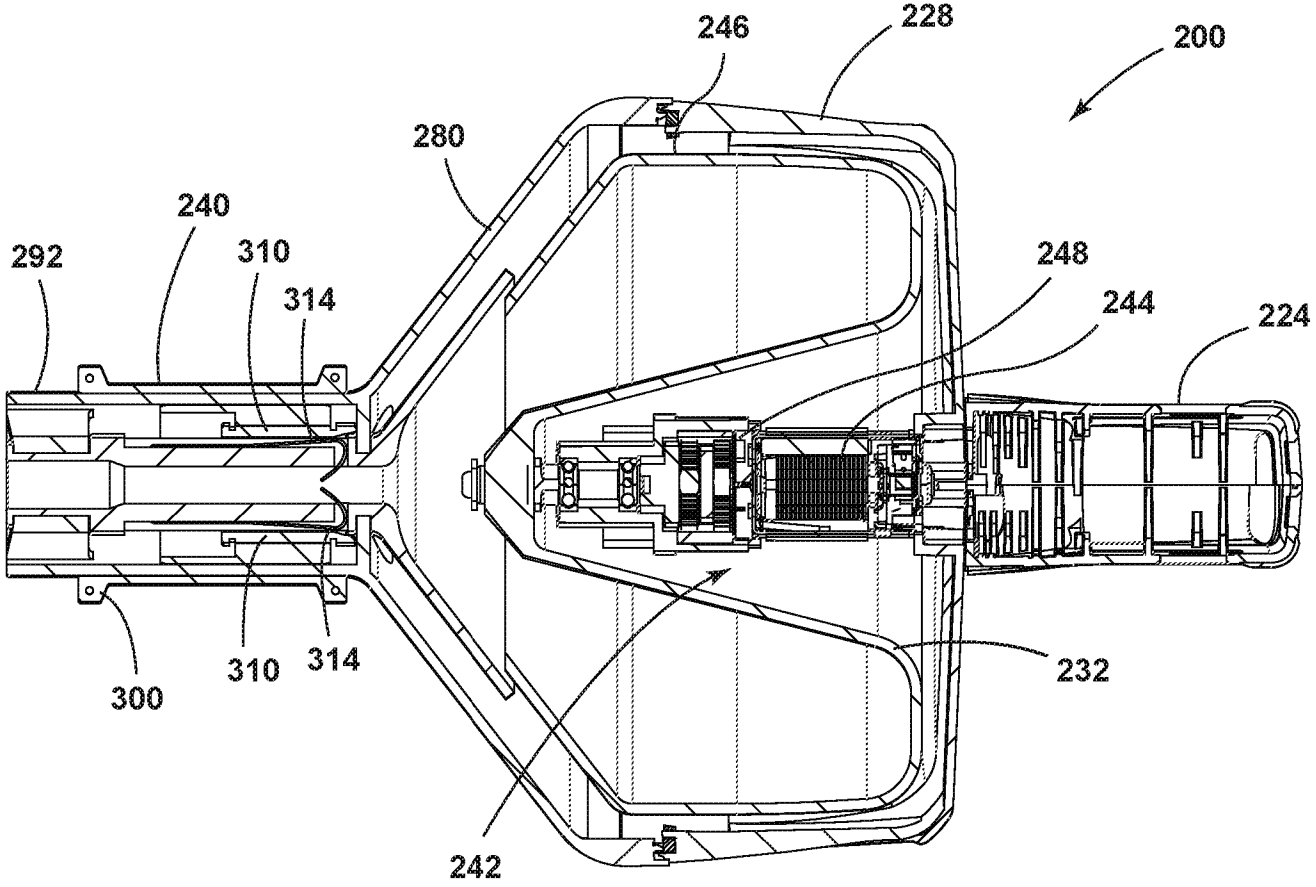
FIG. 14 is a cross-sectional view of the drain cleaner shown in FIG. 11 with the cable lock mechanism in a clamped position.

With reference to FIGS. 12-14, the illustrated drain cleaner 200 also includes a cable lock mechanism 300. The illustrated cable lock mechanism 300 is at least partially supported by the outer shield 280. The cable lock mechanism 300 is slidable along a portion of the nose assembly 240 between an unclamped position (FIGS. 12 and 13) and a clamped position (FIG. 14). The cable lock mechanism 300 includes a cam member 310 that is configured to engage spring clips 314 within the nose assembly 240. The spring clips 314 can selectively clamp the cable to limit or allow axial movement of the cable.

In the unclamped position, the cable lock mechanism 300 is slid forward along the outer shield 280 (i.e., away from a motor and drive mechanism 300 of the drain cleaner 200). In this position, the cam member 310 is not engaged with the spring clips 314. Accordingly, the spring clips 314 are in a neutral, unbiased position and are not engaged with the cable. Therefore, the cable is free to move. In the clamped position, the cable lock mechanism 300 is slid rearward along the outer shield 280 (i.e., toward the motor and drive mechanism 300 of the drain cleaner 200). Sliding the cable lock mechanism 300 in the rearward direction forces the cam members 310 to engage the spring clips 314, which biases the spring clips 314 radially inward. In this position, the spring clips 314 of the cable lock mechanism 300 are forced inward to engage the cable so the cable is clamped. In some embodiments, the cable lock mechanism 300 may be biased toward the unclamped position.

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. A drain cleaner comprising:

a handle assembly including a grip;

a motor supported by the handle assembly;

an actuator supported by the handle assembly adjacent the grip, the actuator electrically coupled to the motor and operable to selectively energize the motor;

a shroud fixed to and extending forwardly from the handle assembly, the shroud being generally cup-shaped and including a closed end facing the handle assembly and an open end facing away from the handle assembly;

a drum assembly rotatably coupled to the handle assembly and positioned within the shroud, the drum assembly operable to be rotated by the motor relative to the handle assembly and the shroud; and a flexible cable stored within the drum assembly, wherein the drum assembly encloses the flexible cable, the flexible cable configured to be extended out of the drum assembly and into a drain.

2. The drain cleaner of claim 1, wherein a portion of the drum assembly is exposed at the open end of the shroud.

3. The drain cleaner of claim 1, further comprising an outer shield fixed to the shroud at the open end, wherein the shroud and the outer shield completely enclose the drum.

4. The drain cleaner of claim 1, further comprising a drive mechanism supported by the handle assembly and coupled to the motor, wherein the drum assembly includes an inner drum supporting the flexible cable and a drum support positioned around the inner drum, and wherein the drum support is coupled to the drive mechanism to transmit rotation of the motor to the drum assembly.

5. The drain cleaner of claim 4, wherein the inner drum includes an open forward end, and wherein the drum assembly further includes a drum cover coupled to the drum support and extending over the open forward end of the inner drum.

6. The drain cleaner of claim 5, wherein the drum cover is coupled to the drum support with threaded fasteners.

7. The drain cleaner of claim 1, wherein the handle assembly includes a stand positioned beneath a center of gravity of the drain cleaner.

8. The drain cleaner of claim 7, wherein the stand includes a generally planar surface extending beneath the motor and the shroud.

9. The drain cleaner of claim 1, further comprising a light supported by the handle assembly between the shroud and the stand, wherein the light is electrically coupled to the actuator such that the actuator is operable to selectively power the light.

10. The drain cleaner of claim 1, wherein the shroud includes a carrying handle extending from an upper surface of the shroud toward the handle assembly.

11. The drain cleaner of claim 1, wherein handle assembly includes a battery receptacle configured to receive a battery pack.

12. The drain cleaner of claim 1, further comprising a nose assembly positioned forward of the shroud, wherein a portion of the drum assembly extends into the nose assembly, and wherein the nose assembly provides a second grip.

13. The drain cleaner of claim 12, wherein the nose assembly includes a lock mechanism and is slidable toward and away from the drum assembly to selectively lock and unlock the flexible cable.

14. The drain cleaner of claim 1, wherein a sidewall of the shroud extending forwardly from the closed end is solid.

15. A drain cleaner comprising:

a handle assembly including a first grip;

a motor supported by the handle assembly;

a shroud fixed to and extending forwardly from the handle assembly, the shroud being generally cup-shaped and including a closed end facing the handle assembly and an open end facing away from the handle assembly;

a drum assembly rotatably coupled to the handle assembly and positioned within the shroud, the drum assembly operable to be rotated by the motor relative to the handle assembly and the shroud;

a nose assembly positioned forward of the shroud, wherein a portion of the drum assembly extends into the nose assembly, the nose assembly including a second grip; and a flexible cable stored within the drum assembly, wherein the drum assembly encloses the flexible cable, the flexible cable configured to be extended out of the drum assembly through the nose assembly and into a drain.

16. The drain cleaner of claim 15, wherein a sidewall of the shroud extending forwardly from the closed end is solid.

17. The drain cleaner of claim 16, wherein the shroud includes an open end facing away from the handle assembly.

18. The drain cleaner of claim 15, wherein the handle assembly includes a battery receptacle configured to receive a power tool battery pack.

19. A drain cleaner comprising:

a handle assembly including a first grip and a battery receptacle configured to couple to a power tool battery pack;

a motor and a drive mechanism at least partially supported by the handle assembly;

an actuator supported by the handle assembly adjacent the first grip, the actuator electrically coupled to the motor and the battery receptacle and operable to selectively energize the motor;

a shroud fixed to and extending forwardly from the handle assembly, the shroud being generally cup-shaped and including a closed end facing the handle assembly and an open end facing away from the handle assembly;

a drum assembly rotatably coupled to the handle assembly and positioned within the shroud, the drum assembly operable to be rotated by the motor and the drive mechanism relative to the handle assembly and the shroud;

a nose assembly positioned forward of the shroud, wherein a portion of the drum assembly extends into the nose assembly, the nose assembly including a second grip; and a flexible cable stored within the drum assembly, wherein the drum assembly encloses the flexible cable, the flexible cable configured to be extended out of the drum assembly through the nose assembly and into a drain.

* * * * *